US007034687B2

(12) United States Patent
Franklin et al.

(10) Patent No.: US 7,034,687 B2
(45) Date of Patent: Apr. 25, 2006

(54) ERROR-AVOIDING ANTI-THEFT SURVEILLANCE SYSTEM

(75) Inventors: Todd B. Franklin, Tallahassee, FL (US); Paul Kelley, Boca Raton, FL (US)

(73) Assignee: Comm-Engines, Tallahassee, FL (US)

( * ) Notice: Subject to any disclaimer, the term of this patent is extended or adjusted under 35 U.S.C. 154(b) by 133 days.

(21) Appl. No.: 10/835,131

(22) Filed: Apr. 29, 2004

(65) Prior Publication Data

US 2005/0242954 A1 Nov. 3, 2005

(51) Int. Cl.
*G08B 13/14* (2006.01)

(52) U.S. Cl. ..... 340/572.2; 340/567

(58) Field of Classification Search ..... 340/572.2
See application file for complete search history.

(56) References Cited

U.S. PATENT DOCUMENTS

| | | | | |
|---|---|---|---|---|
| 2,774,060 | A | | 12/1956 | Thompson |
| 3,098,971 | A | | 7/1963 | Richardson |
| 3,384,892 | A | | 5/1968 | Postman |
| 3,493,955 | A | | 2/1970 | Minasy |
| 3,518,546 | A | | 6/1970 | Augenblick et al. |
| 3,711,848 | A | | 1/1973 | Martens |
| 3,754,226 | A | | 8/1973 | Fearon |
| 3,895,368 | A | | 7/1975 | Gordon et al. |
| 4,063,229 | A | | 12/1977 | Welsh et al. |
| 4,139,844 | A | | 2/1979 | Reeder |
| 5,030,940 | A | * | 7/1991 | Siikarla ..... 340/572.2 |
| 5,942,977 | A | | 8/1999 | Palmer et al. |
| 6,104,285 | A | * | 8/2000 | Stobbe ..... 340/505 |
| 6,163,259 | A | | 12/2000 | Barsumian et al. |

* cited by examiner

*Primary Examiner*—Jeffery Hofsass
*Assistant Examiner*—George Bugg
(74) *Attorney, Agent, or Firm*—John Wiley Horton

(57) ABSTRACT

An anti-theft surveillance system capable of detecting the presence of tags affixed to merchandise. The tags contain a diode attached to two dipole elements. When the tag receives alow frequency signal and a high frequency signal, it will emit two side bands. The system includes alow frequency transmitter, a high frequency transmitter, and a receiver. The two transmitters place alow frequency signal and a high frequency signal in proximity to the guarded area (typically a store doorway). When a tag is near the doorway, the receiver will receive the upper side band and lower side band. The receiver reduces the frequency of the upper and lower side band signals to form an intermediate frequency upper side band and an intermediate frequency lower side band. These two intermediate frequency signals are then fed into two separate detector circuits. One circuit detects the presence of the intermediate frequency upper side band and the other circuit detects the presence of the intermediate frequency lower side band. Only if both side bands are detected is an alarm created.

15 Claims, 8 Drawing Sheets

ERROR-AVOIDING ANTI-THEFT SURVEILLANCE SYSTEM

BACKGROUND OF THE INVENTION

1. Field of the Invention

This invention relates to the field of theft prevention. More specifically, the invention comprises a system for detecting the presence of an identifying tag affixed to merchandise. The system includes novel features which greatly reduce the possibility of false alarms 2. Description of the Related Art Theft detection systems have been in common use for many decades. One type of prior art system uses microwave transmissions to excite and detect a tag affixed to the merchandise to be protected. A system employing this technology is disclosed in U.S. Pat. No. 3,895,368 to Gordon (1975) and U.S. Pat. No. 4,063,229 to Welsh et. al. (1977).

The basic components of such systems are disclosed schematically in FIG. 1. Broadly, the system includes two transmitters. The first is a microwave transmitter operating in the region of 902 to 928 MHz. The second is a high voltage transmitter operating at much lower frequencies, such as 50 KHz. The two transmitters are equipped with appropriate antennas positioned to create a signal in the vicinity of a retail store's entrance/exit.

FIG. 5 illustrates a typical prior art installation. The objective is to provide surveillance of doorway 100 (typically the point of entry and departure for a retail sales establishment). An antenna for the microwave transmitter is located on each side of the doorway. Each antenna is housed within a microwave antenna housing 102. An antenna for the high voltage transmitter often spans most of the doorway's width. It can be located above the doorway, such as high voltage antenna 104 in FIG. 5. A control unit 106 is mounted somewhere nearby. It contains the systems disclosed in FIG. 1, along with power supplies and other conventional electronic components.

Returning to the prior art system shown in FIG. 1, the reader will also note the existence of the portion labeled receiver 46. This is the detecting side of the system. All these components interact with tags placed on the items within the store in order to determine when a tag is placed near the doorway (such as by a shoplifter exiting the store with stolen goods).

The tag is shown schematically in FIG. 2. Tag 66 contains a diode 68 attached to dipole element 70 and dipole element 72. The electronic components are housed within a durable tamper-proof housing (not shown). This housing is attached to the goods using tamper-proof pins, lanyards, or other known devices. When an item is lawfully purchased, a store clerk removes the tag using specialized equipment (in the case of reusable tags), or destroys the dipole circuit (in the case of disposable tags).

Those skilled in the art will realize that the system shown in FIG. 1 will create two fields in the area around the doorway: (1) an electromagnetic field produced by the high frequency microwave transmitter (902 to 928 MHz); and (2) an electrostatic field produced by the high voltage/low frequency transmitter (such as 50 KHz). Tag 66 is a passive electromagnetic wave receptor-reradiator with signal mixing capability. When a tag 66 is placed in the two fields, it will cause the radiation of two side bands. As an example, assume that the microwave transmitter is set for 915 MHz and the high voltage transmitter is set for 50 KHz. The dipole will emit side bands at 914.95 MHz (915 MHz−50 KHz) and 915.05 MHz (915 MHz+50 KHz), the sum and difference of the two signals. These side bands will typically only exist when a tag is near the doorway. Thus, these side bands can be used to indicate the presence of a tag.

The operation of the prior art device will now be described in greater detail. Transmitter 10 can be selected or set to transmit a microwave signal lying within the band between 902 and 928 MHz. For this example, assume the transmitter is set for 915 MHZ. The transmitter produces output signal 12. It may also produce low power reference signal 20 (having the same characteristics but much lower amplitude). Output signal 12 feeds into amplifier 14. The boosted signal is then fed into band-pass filter 16 (which is centered on 915 MHz). After passing the filter, the amplified signal is fed to antenna 18.

High voltage transmitter 48 starts with oscillator 50. In this example, an oscillator producing a 50 KHz signal is used. The oscillator is modulated by the output of FM modulator 112. In this example, a 1 KHz tone is used as the modulation signal.

The modulated signal is then amplified by amplifier 60. The signal then passed through step-up transformer 62 which substantially increases the voltage before feeding the signal to antenna 64. As explained previously, the antennas for both the microwave transmitter and the high voltage transmitter are placed to establish a signal in the region of the doorway.

Of course, the prior art system also incorporates a receiver with a detector. This portion is shown generally as receiver 46. Antenna 22 receives signals radiated by tag 66. These are then sent through band-pass filter 24 (typically centered on 915 MHZ). The filtered signal is then amplified by amplifier 26 before being fed into mixer 28.

Antenna 22 will pick up all signals in the vicinity of the doorway. Thus, it will pick up the 915 MHz microwave transmitter signal, the 50 KHz high voltage signal, and the two side bands (914.95 MHz and 915.05 MHZ) if a tag is present (Those skilled in the art will know that an antenna optimized for the 902 to 928 MHz band may receive little of the 50 KHz signal). Once the signal has traveled through band-pass filter 24, only the signals within the 902 to 928 MHz band will remain.

One of the functions of mixer 28 is to remove the 915 MHz signal, so that the presence of a side band can be more easily detected. A 915 MHz low power reference signal 20 can be fed into mixer 28 from transmitter 10 to establish a reference for the removal of the 915 MHz signal. Alternatively, a second and completely independent device can be used to feed a 915 MHz reference signal into mixer 28. However such a signal is established, it must be matched to the frequency of the transmitter's signal.

If a tag is present, mixer 28 will receive signals centered on 914.95 MHz, 915.00 MHz, and 915.05 MHz. The mixer then strips out the 915.00 MHz signal by conventional means. The result is that the two side band signals remain. After the removal of the 915.00 MHz signal, the two side bands will simply be two out-of-phase 50 KHz signals. These are then fed into FM detector 30, which is optimized for the detection of the 1 KHz modulation tone which is present on the 50 KHz signal. When a 1 KHz signal is detected by FM detector 30, it sends a 1 KHz signal to logic unit 32. Logic unit 32 is a conventional arrangement of logic circuits used to monitor the output of the FM detector. It maybe configured, as an example, to require that the FM detector produce a positive and steady signal for 0.5 seconds before it transmits a signal sounding alarm 40. The logic circuit thereby reduces false alarms caused by extraneous signals (which typically only exist for a short duration). The logic unit also allows the assembly to be reset to an inert state.

Those skilled in the art will know that devices such as shown in FIG. 1 often require a more complex antenna. FIG. 4 shows a more realistic antenna circuit for the microwave transmitter and receiver. A splitter 92 is added to the circuit of FIG. 1. It splits the microwave signal to be fed into two antennas 18.

The receiver is likewise modified to include two antennas 18. These two signals are fed into combiner 98, which then feeds the signal into band-pass filter 24. The balance of the receiver circuit is the same as in FIG. 1. The modification of FIG. 4 corresponds to the installation shown in FIG. 5, where two microwave antenna housings are shown.

Of course, the reader will appreciate that many other controls and features can be added to the system, including frequency tuning inputs, power settings, etc. However, the function of the prior art device is well illustrated by the components shown without adding undue complexity.

Over the years the prior art devices have been prone to high false alarm rates. Returning to FIG. 1, those skilled in the art will readily understand this problem. FM detector 30 is set to trigger an alarm when it receives a 50 KHz signal. The reader will recall that a 50 KHz signal is produced by high voltage transmitter 48. If the high voltage transmitter signal "leaks" into the receiver circuit, a false alarm will result.

No such leakage will occur in the schematic shown in FIG. 1. However, the reader will appreciate that the electrical isolation shown in the schematic is difficult to achieve in the real world.

In actual applications, "cross talk" is a fact of life. The 50 KHz high voltage signal (including the modulation signal) maybe inductively carried into antenna 22, the connective leads, the housing for the components, and many other features.

Users of such systems have had to resort to reducing the power of the 50 KHz signal to eliminate cross talk and resulting false alarms. In many installations, the power must be reduced to the point where the system can no longer reliably detect a tag.

The reader should appreciate that the cross talk problem is not unique to the selection of a 50 KHz high voltage signal in the example. If a 100 KHz signal is used, then FM detector 30 must be tuned to 100 KHz in order to detect the side band. Thus, the same cross talk problem persists, even though it occurs on the basis of a "false" 100 KHz signal rather than a "false" 50 KHz signal.

The prior art systems must generally be very carefully tuned in order to function at all. Returning to FIG. 5, the reader will recall that three different antenna housings are used. A skilled technician must typically place and tune these antennas in order to minimize the cross talk problem. This problem increases the cost of acquisition for the customer.

BRIEF SUMMARY OF THE INVENTION

The present invention comprises an anti-theft surveillance system capable of detecting the presence of tags affixed to merchandise. The tags contain a diode attached to two dipole elements. When the tag receives a low frequency signal and a high frequency signal, it will emit a lower side band equal to the difference between the two frequencies and an upper side band equal to the sum of the two frequencies.

The system includes a low frequency transmitter, a high frequency transmitter, and a receiver. The two transmitters place a low frequency signal and a high frequency signal in proximity to the guarded area (typically a store doorway). When a tag is near the doorway, the receiver will receive the upper side band and lower side band from the tag.

The receiver includes a mixer which reduces the frequency of the upper and lower sideband signals to form an intermediate frequency upper side band and an intermediate frequency lower side band. These two intermediate frequency signals are then fed into two separate detector circuits. One circuit detects the presence of the intermediate frequency upper side band and the other circuit detects the presence of the intermediate frequency lower side band. Only if both side bands are detected is an alarm created.

The use of intermediate frequencies in the receiver greatly reduces the risk of signal leakage from the low frequency transmitter causing false alarms. The use of the dual detection circuits likewise greatly reduces the risk of false alarms.

REFERENCE NUMERALS IN THE DRAWINGS

| | | | |
|---|---|---|---|
| 10 | transmitter | 12 | output signal |
| 14 | amplifier | 16 | band-pass filter |
| 18 | antenna | 20 | low power reference signal |
| 22 | antenna | 24 | band-pass filter |
| 26 | amplifier | 28 | mixer |
| 30 | FM detector | 32 | logic unit |
| 40 | alarm | 42 | microwave transmitter |
| 46 | receiver | 48 | high voltage transmitter |
| 50 | oscillator | 60 | amplifier |
| 62 | step-up transformer | 64 | antenna |
| 66 | tag | 68 | diode |
| 70 | dipole element | 72 | dipole element |
| 74 | modulator | 76 | mixer |
| 78 | amplifier | 80 | upper side band receiver |
| 82 | lower side band receiver | 84 | upper side band detector |
| 86 | lower side band detector | 88 | logic circuit |
| 90 | alarm | 92 | splitter |
| 98 | combiner | 100 | doorway |
| 102 | microwave antenna housing | 104 | high voltage antenna |
| 106 | control unit | 108 | unified antenna housing |
| 110 | mall entrance | 112 | FM modulator |
| 114 | oscillator | 116 | upper frequency reducer |
| 118 | lower frequency reducer | | |

DETAILED DESCRIPTION OF THE INVENTION

Figure 3:
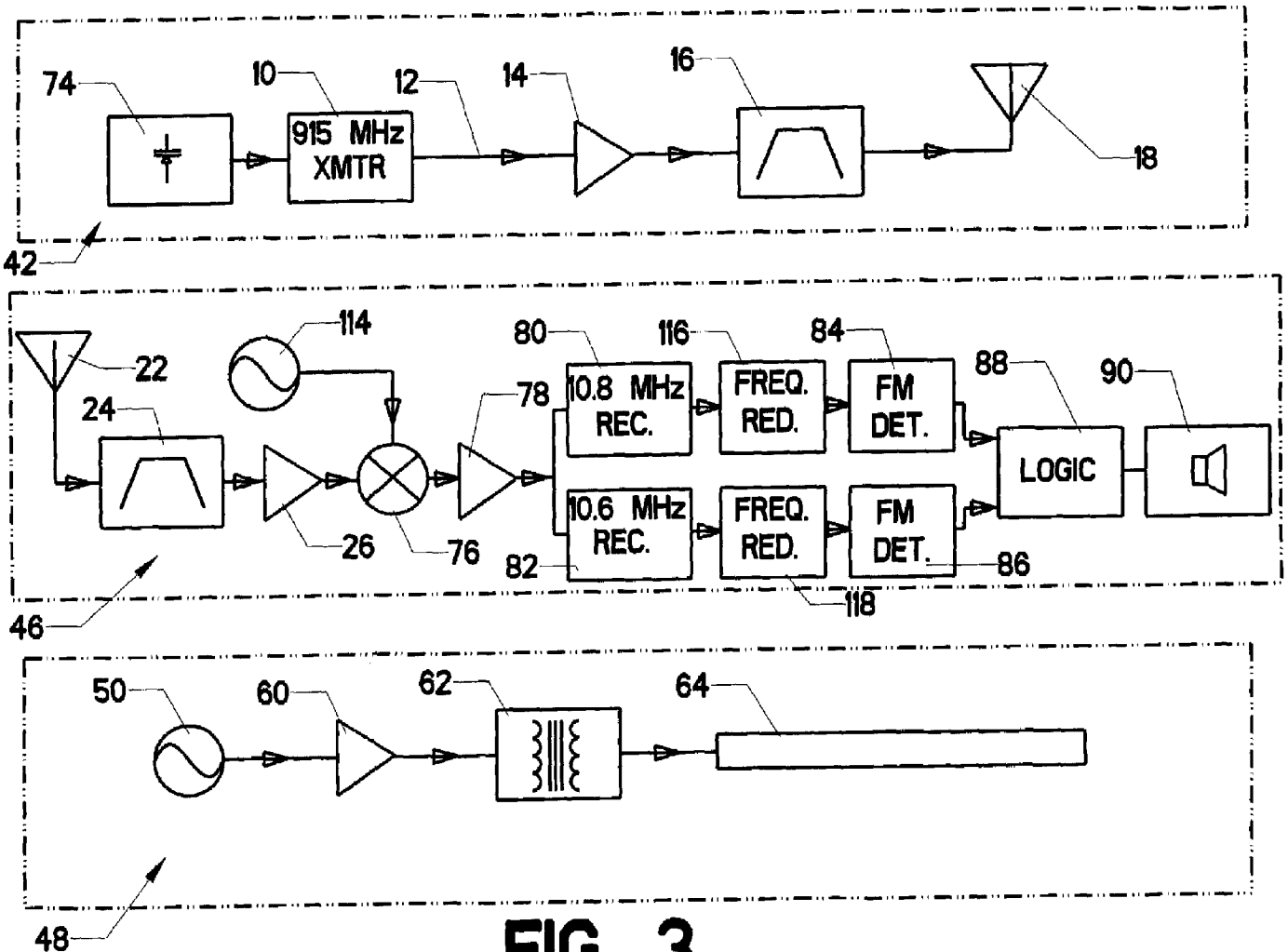
FIG. 3 is a schematic view, showing the present invention.

FIG. 3 shows one embodiment of the present invention in schematic form. Like the prior art device, it is divided into three sections: (1) microwave transmitter 42, (2) high voltage transmitter 48, and (3) receiver 46. There are several substantial differences from the prior art, however, which will be made apparent in the following description.

Microwave transmitter 42 starts with modulator 74. This creates a modulation signal in the audio range (300 Hz to 15 KHz). This signal is then fed into transmitter 10, where it combines with the high frequency signal created by transmitter 10. The transmitter creates a signal lying between 902 and 928 MHz. For this example, the transmitter will be set for 915 MHz. The modulation signal will be set for 1 KHz.

Output signal 12 therefore contains the modulated 915 MHz transmitter signal. Like in the prior art, output signal 12 is fed through an amplifier 14 and a band-pass filter 16 before being fed to antenna 18. Antenna 18 projects the signal in the vicinity of the doorway.

High voltage transmitter 48 starts with an oscillator 50. Unlike the prior art, the output of this oscillator is not frequency modulated. The unmodulated signal is amplified by amplifier 60 and stepped up in voltage by step-up transformer 62. The resulting signal is then fed to antenna 64, which projects the signal in the vicinity of the doorway. For this example, a 100 KHz high voltage signal will be used.

Figure 1:
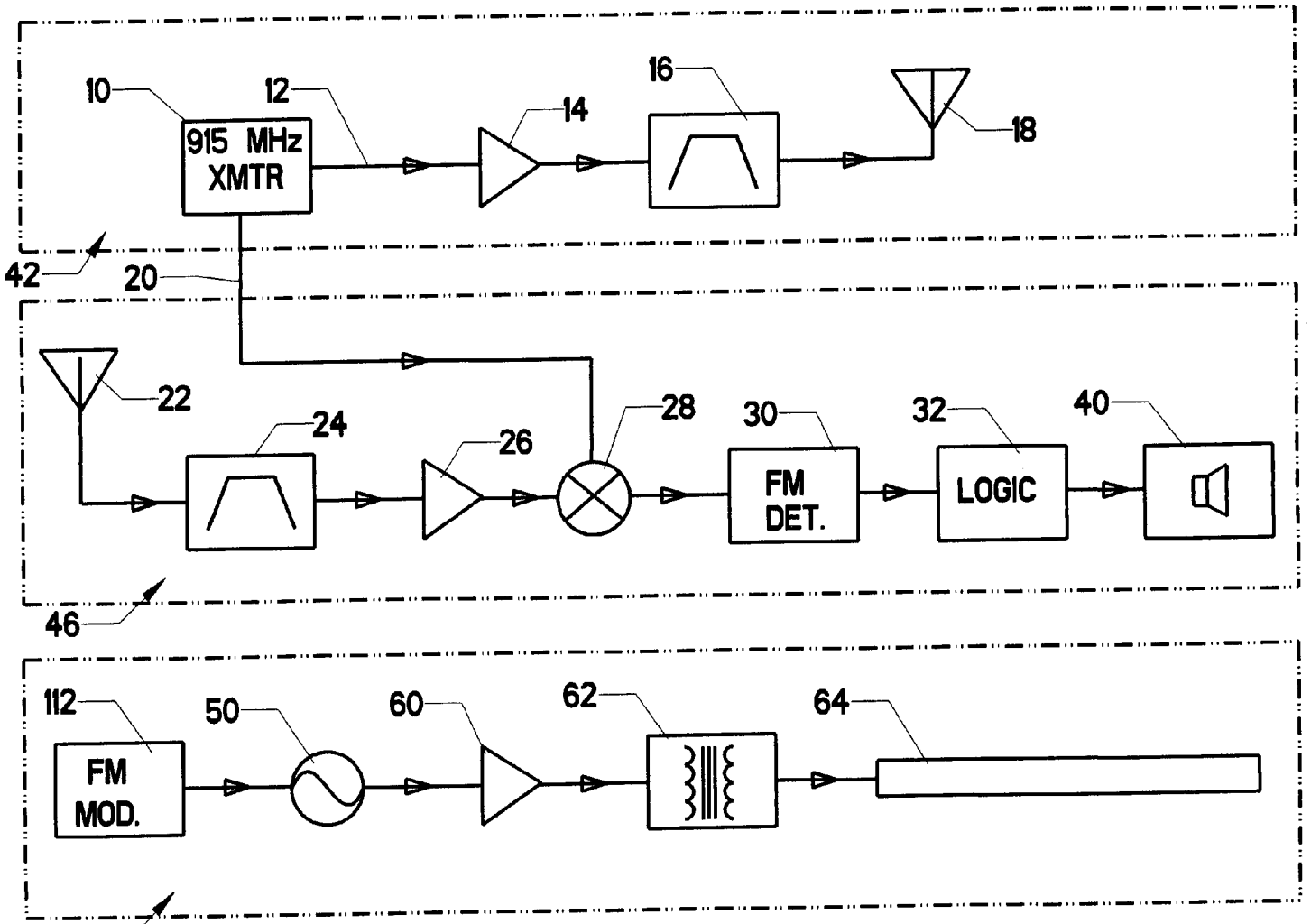
FIG. 1 (PRIOR ART)
FIG. 1 is a schematic view, showing a prior art detector.
Figure 2:
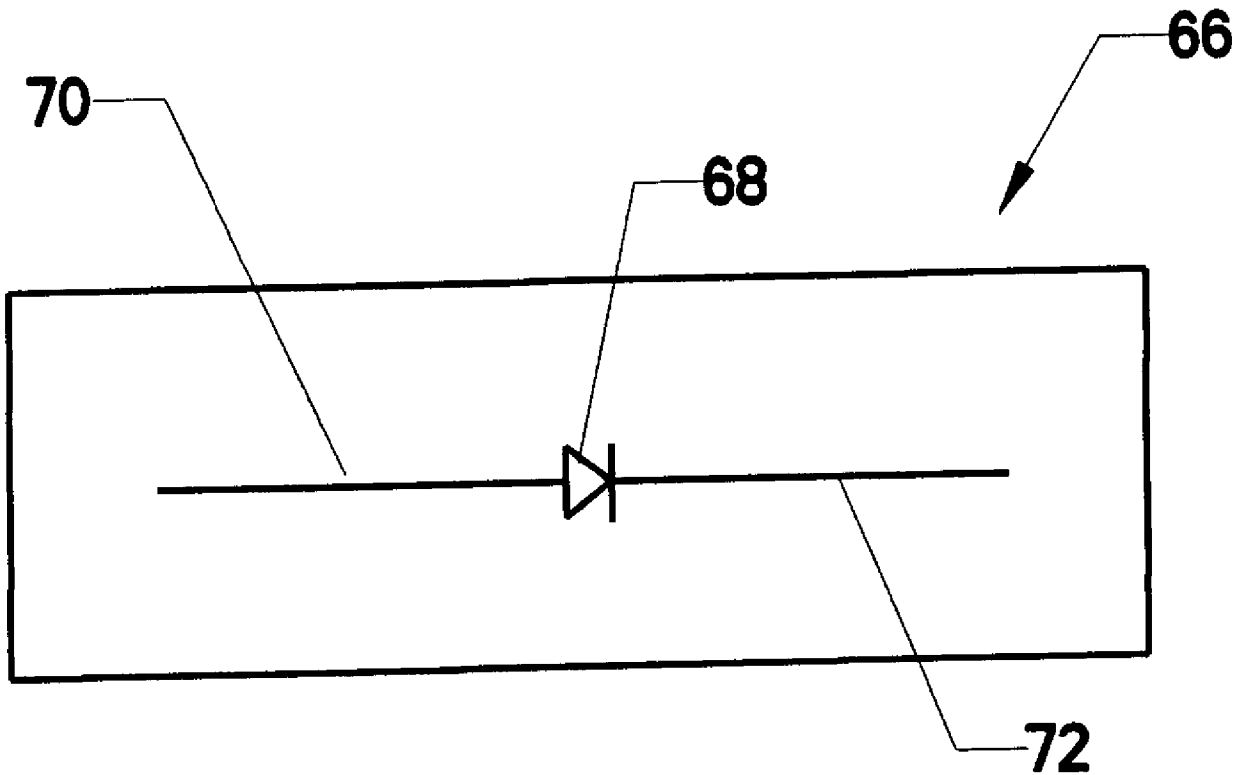
FIG. 2 (PRIOR ART)
FIG. 2 is a schematic view, showing a prior art dipole tag.

The tag used with the system (shown in FIG. 2) is identical to the one used in the prior art. In fact, the present system is able to use prior art tags without any modification to the tag.

Two signals are present in the doorway using the system shown in FIG. 3: (1) a 100 KHz high voltage signal, and (2) a modulated 915 MHz signal. If a tag is present, two side bands will be created— a high side band at 915.10 MHz (915 MHz+100 KHz) and a low side band at 914.9 MHz (915 MHz−100 KHz). The present invention processes these side bands in a different manner than the prior art.

Receiver 46 starts with antenna 22. The signal then passes through band-pass filter 24, which is centered on 915 MHz. Thus, when a tag is present, the signal leaving the band-pass filter will include components at 914.90 MHz, 915.00 MHz, and 915.10 MHz. The signal is amplified by amplifier 26 before passing into mixer 76.

Mixer 76 performs several functions. It generally requires a reference signal, which is provided by oscillator 114. Unlike the prior art, mixer 76 does not simply strip out the 915 MHz signal. Instead, it uses known techniques to reduce the frequency of all three bands to entirely different intermediate frequencies. As an example, oscillator 114 can be selected to provide a 904.3 MHz reference signal. Mixer 76 then reduces the incoming frequencies by this reference signal. Thus, if the incoming side bands are 914.90 MHz and 915.10 MHz, the mixer subtracts the 904.3 MHz signal from both to produce signals at 10.6 MHz and 10.8 MHz (The reader should bear in mind that the 1 KHz audio tone created by modulator 74 will be present on all these signals).

The selection of intermediate frequencies centered on 10.7 MHz is not a limitation of the invention. Numerous intermediate frequencies ("IF's") could be selected, with the choice being logically dictated by the availability of suitable hardware. Whatever the selection, the IF's created are then amplified by amplifier 78 and split into two identical signals.

The two signals are fed into upper side band receiver 80 and lower side band receiver 82. The upper side band receiver feeds the signal into upper frequency reducer 116. This module down converts the 10.8 MHz signal to a455 KHz signal for added gain and filtering. The 455 KHz signal is then fed into upper side band detector 84. Upper sideband detector 84 is a quadrature-type which strips off the 1 KHz audio tone found within the 455 KHz signal. The detector then measures the frequency of the audio tone and sends a positive signal to logic unit 88 is the frequency matches the predetermined set frequency (In this case the 1 KHz tone generated by modulator 74).

The lower side band is processed in the same fashion. Lower side band receiver 82 feeds into lower frequency reducer 118. The 10.6 MHz signal is down converted to 455 KHz and fed into lower side band detector 86. Lower side band detector 86 analyzes the signal to detect the presence of the 1 KHz audio tone, sending a positive signal to the logic unit if the 1 KHz signal is found. The reader should note that the use of a 455 KHz signal is merely to take advantage of common commercially-available components. Any suitable frequency could be substituted.

Logic unit 88 is configured to sound the alarm only if it receives a positive signal indicating that both side bands contain the correct audio tone modulation (in this case 1 KHz). It may also include other standard features, such as a timing function that will not sound alarm 90 until both side bands have been detected for a period of time (thereby eliminating erroneous transient effects).

The reader will now understand the operation of the present invention, and further be able to appreciate the differences over the prior art. First, the present invention seeks to detect both side bands radiating from the dipole tag. Only if modulation signals on both side bands are detected will it sound the alarm. This feature greatly reduces false alarms caused by external effects, since it is extremely unlikely for external interference to create signals on both side band frequencies.

The present invention also processes the signals in a different fashion by using intermediate frequencies (IF's) downstream of mixer 76. This feature is very significant, since it virtually eliminates the cross talk problem inherent in the prior art. The present invention may still "see" cross talk in the receiver circuit, but it causes no problems. The 1 KHz modulation signal (which is the "target" of the detection circuitry) is carried through a series of intermediate frequencies. The chance of interference effects being able to create such a 1 KHz tone in the critical portions of the detection circuit is remote. Additionally, an interference effect would have to create a false 1 KHz signal on both detection circuits in order to create a false alarm.

A simple example will make this point clear. Assuming from the prior explanation that a 100 KHz high voltage signal is used, this signal may well find its way into the receiver circuit downstream of amplifier 26. Because the mixer reduces the frequency of all the signals down to values centered on 10.70 MHz (10.60 MHz, 10.70 MHz, and 10.80 MHz), upper side band receiver 80 and lower side band receiver 82 can be tuned to detect these IF's rather than the 100 KHz signal which would need to be detected if the 915 MHz signal was simply stripped out by mixer 76. Thus, although the 100 KHz signal maybe present, neither of the side band receivers will "see" it. The cross talk therefore causes no false alarms.

This feature creates other practical advantages. The present invention can place the microwave and high voltage antennas close to each other, since the cross talk between the two will not cause false alarms. A unified housing containing all the antennas (the high voltage antenna, the microwave transmitter antenna, and the receiver antenna) can be used.

Figure 6:
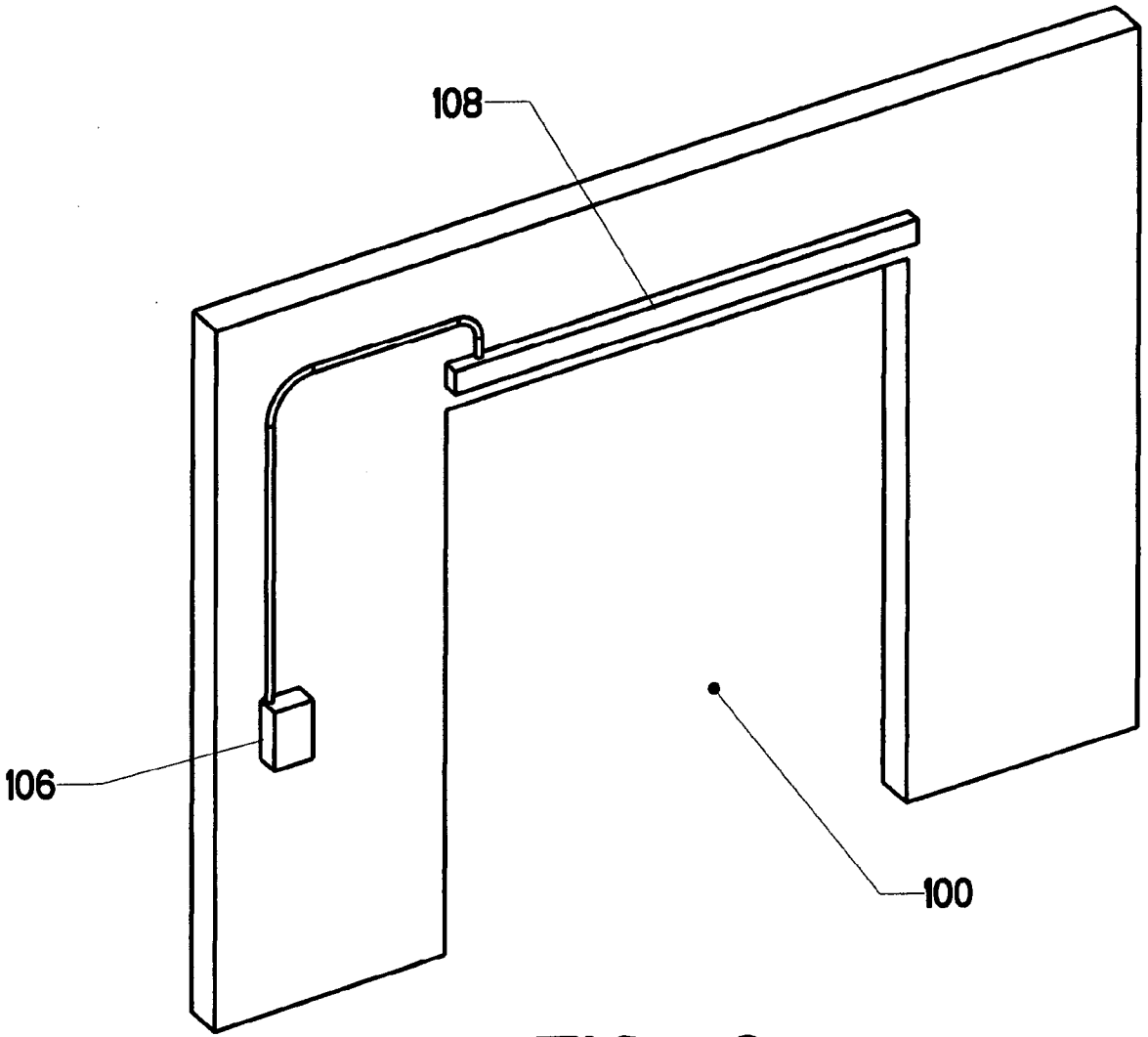
FIG. 6 is a perspective view, showing an installation for the present invention.

FIG. 6 shows a physical installation of the present invention. Unified antenna housing 108 is placed near doorway 100, typically over its top. It need not be tuned. In fact, the present system can generally be installed directly by the customer. He or she will place the antenna in position and run the wiring. The device is then ready for use.

Figure 7:
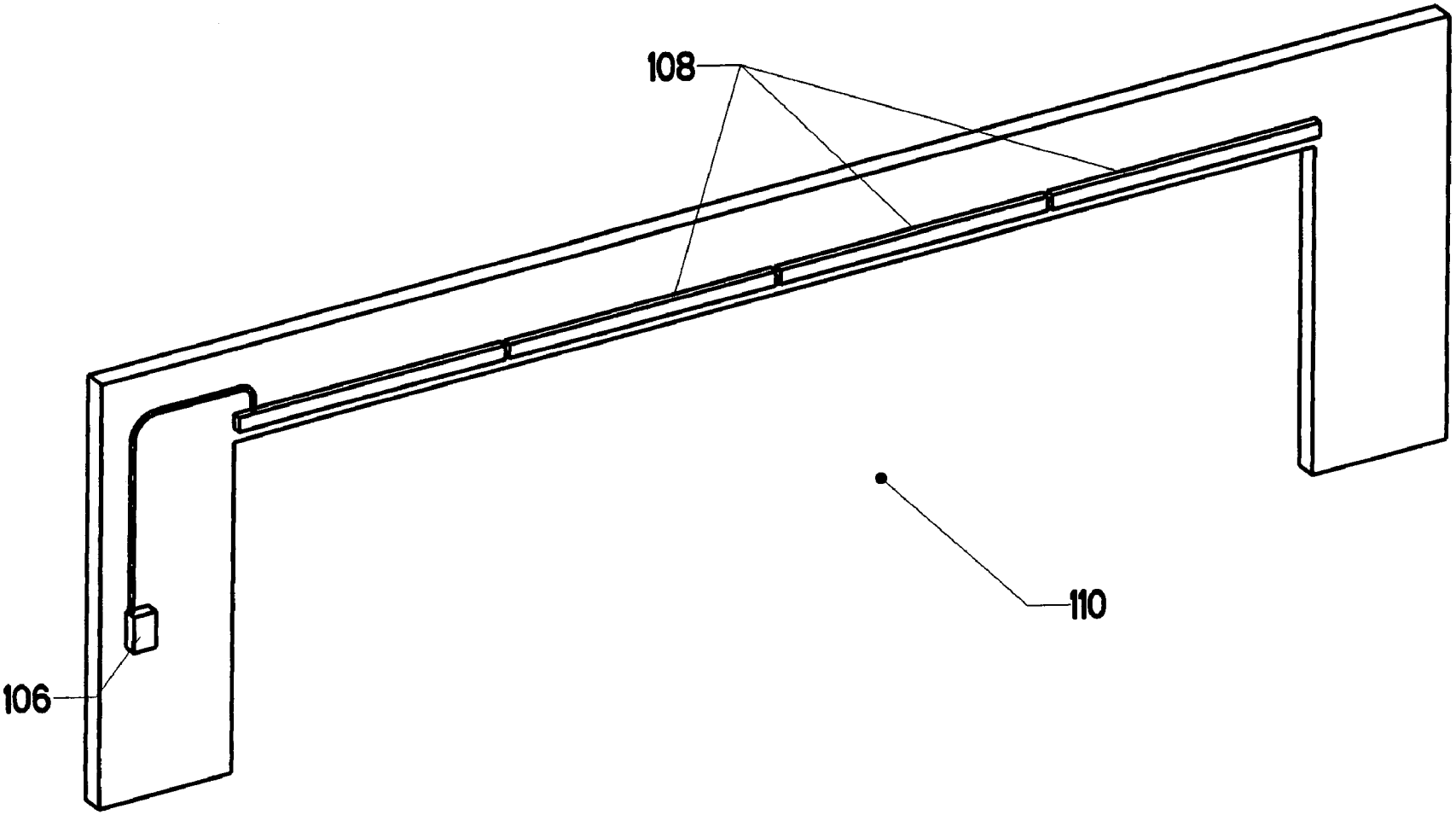
FIG. 7 is a perspective view, showing an installation for the present invention.

FIG. 7 shows another typical installation configured to cover a mall opening 110. Mall openings are often 20 to 40 feet wide, which is beyond the detection range of a single transmitter and receiver. Such an opening can be covered by using two, three, or more units arrayed across the width. These can operate independently, or under a single controller. Again, because cross talk will not produce false alarms, the placement of multiple antennas in close proximity is not a problem.

Of course, several stores within the same mall may wish to use the present invention. Different frequencies can be used for systems near each other to prevent problems. Returning to FIG. 3, the reader will recall that transmitter 10 was set to 915 MHz. Any frequency within the range of 902 to 928 MHz could be used instead. The functions of mixer 76 and the associated detector circuits will then have to be adjusted to "look" for the correct side band frequencies.

This is not a problem using modem electronics. Rather than fixed oscillators, the system can use phase locked loops and associated control circuitry. These devices can be used to adjust the frequency to a desired setting over a range. Such devices can be controlled in unison. In other words, the user could set a frequency of 908 MHz at the control unit. Controlling devices would then "tune" the transmitter, as well as the mixer (so that appropriate IF frequencies would be created). The side band receivers can also be tuned in this fashion. The user only needs to set a single frequency. All the components which depend upon that frequency are then adjusted automatically.

The band-pass filters can likewise be adjusted. However, it is also possible to use band-pass filters centered on 915 MHz which have enough bandwidth to accommodate a system tuned anywhere between 902 and 928 MHz.

Figure 3B:
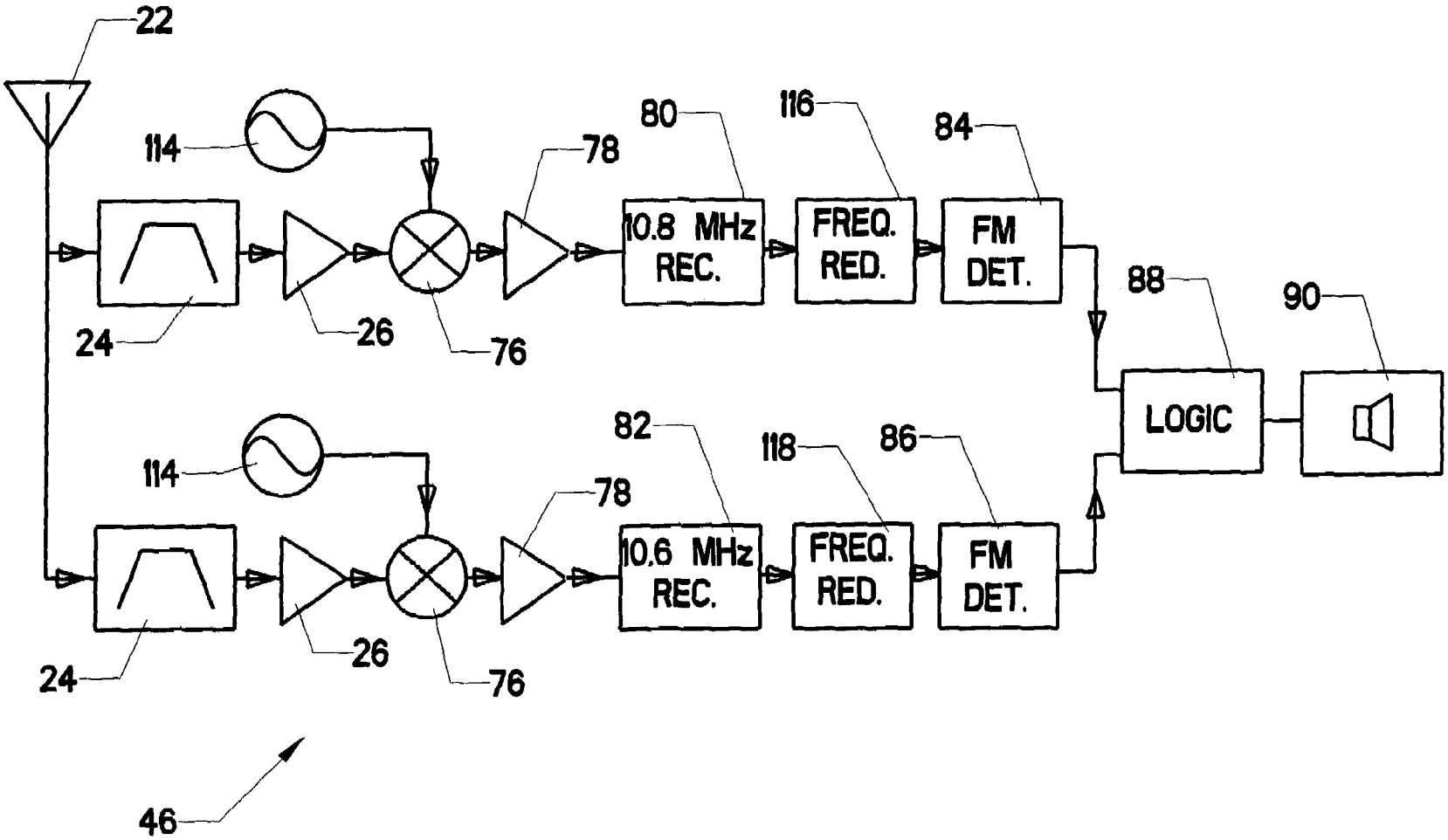
Figure 4:
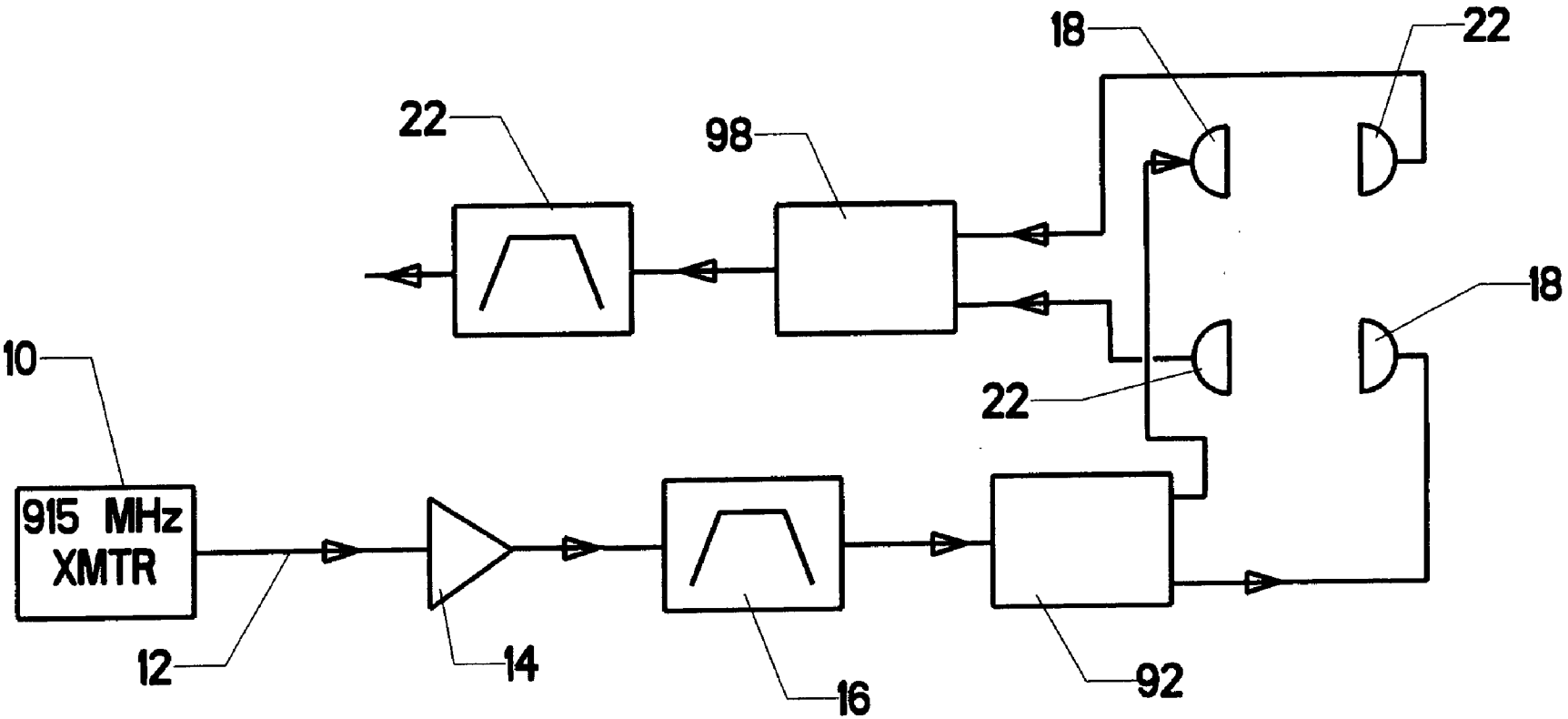
FIG. 4 (PRIOR ART)
FIG. 4 is a schematic view, showing a prior art detector with a split antenna circuit.
Figure 5:
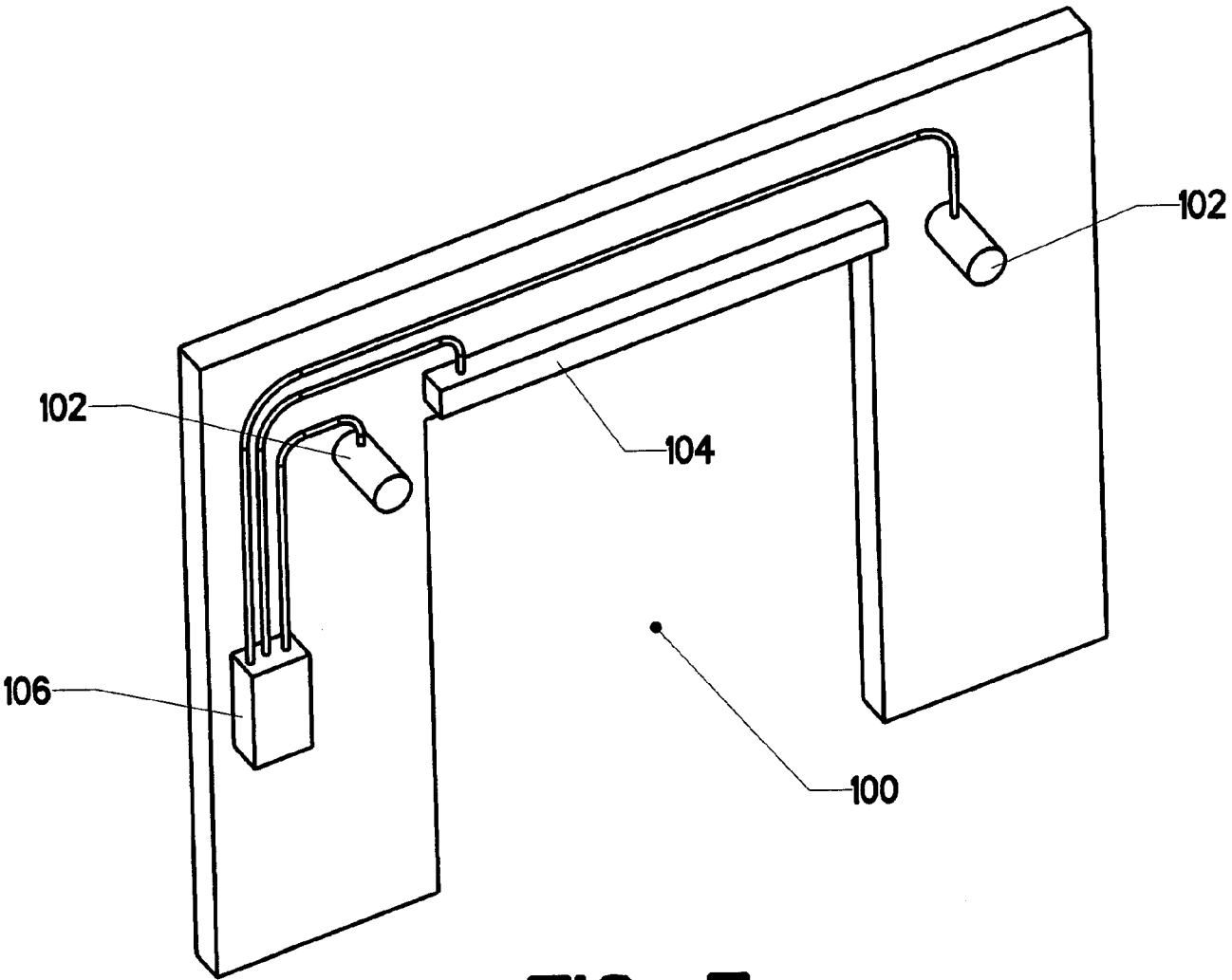
FIG. 5 (PRIOR ART)
FIG. 5 is a perspective view, showing a prior art detector installation.

Those skilled in the art will realize that many different electrical circuits could be created to carry out the present invention. FIG. 3 shows only one example. FIG. 3B shows an alternate embodiment for receiver 46. Two separate receiver circuits are employed to analyze signals which are split immediately after leaving antenna 22. The detection functions are identical. However, the arrangement shown in FIG. 3B may allow the use of complete receiver assemblies which are commercially available. The circuit could be drawn in many other ways while still carrying out the same functions.

Although the preceding description contains significant detail regarding the novel aspects of the present invention, it should not be construed as limiting the scope of the invention, but rather as providing illustrations of the preferred embodiments. Thus, the scope of the invention should be fixed by the following claims, rather than by the examples given.

We claim:

1. A system for detecting the presence of a passive electromagnetic wave receptor-reradiator with signal mixing capability in proximity to a doorway, comprising:

a. a first transmitter transmitting a low frequency signal in proximity to said doorway;

b. a second transmitter transmitting a high frequency signal in proximity to said doorway, so that when said passive electromagnetic wave receptor-reradiator is in proximity to said doorway, said passive electromagnetic wave receptor-reradiator will emit an upper side band having a frequency equal to the sum of said low frequency and said high frequency signals, and a lower side band having a frequency equal to the difference between said low frequency and said high frequency signals;

c. a receiver, including i. a frequency reducer, capable of reducing the frequency of said upper sideband and said lower side band to produce an intermediate frequency upper side band and an intermediate frequency lower side band;

ii. an intermediate frequency upper side band detecting circuit tuned to detect the presence of said intermediate frequency upper side band and emit a first positive signal in response thereto;

iii. an intermediate frequency lower side band detecting circuit tuned to detect the presence of said intermediate frequency lower side band and emit a second positive signal in response thereto; and iv. a logic unit configured to create an alarm when both said first positive signal and said second positive signal are present.

2. A system for detecting the presence of a passive electromagnetic wave receptor-reradiator with signal mixing capability in proximity to a doorway, comprising:

a. a first transmitter transmitting a low frequency signal in proximity to said doorway;

b. a second transmitter transmitting a high frequency signal modulated by an audio frequency signal in proximity to said doorway, so that when said passive electromagnetic wave receptor-reradiator is in proximity to said doorway, said passive electromagnetic wave receptor-reradiator will emit an upper side band having a frequency equal to the sum of said low frequency and said high frequency signals, and a lower side band having a frequency equal to the difference between said low frequency and said high frequency signals;

c. a receiver, including i. a frequency reducer, capable of reducing the frequency of said upper sideband and said lower side band to produce an intermediate frequency upper sideband and an intermediate frequency lower side band, with both said intermediate frequency upper side band and said intermediate frequency lower side band carrying said audio frequency signal;

ii. an intermediate frequency upper side band detecting circuit tuned to detect the presence of said audio frequency signal on said intermediate frequency upper side band and emit a first positive signal in response thereto;

iii. an intermediate frequency lower side band detecting circuit tuned to detect the presence of said audio frequency signal on said intermediate frequency lower side band and emit a second positive signal in response thereto; and iv. a logic unit configured to create an alarm when both said first positive signal and said second positive signal are present.

3. A system for detecting the presence of a passive electromagnetic wave receptor-reradiator with signal mixing capability in proximity to a doorway, comprising:

a. a first transmitter transmitting a low frequency signal in proximity to said doorway;

b. a second transmitter transmitting a high frequency signal modulated by an audio frequency signal in proximity to said doorway, so that when said passive electromagnetic wave receptor-reradiator is in proximity to said doorway, said passive electromagnetic wave receptor-reradiator will emit an upper side band having a frequency equal to the sum of said low frequency and said high frequency signals, and a lower side band having a frequency equal to the difference between said low frequency and said high frequency signals;

c. a receiver, including i. a first frequency reducer, capable of reducing the frequency of said upper side band and said lower side band to produce a first intermediate frequency upper side band and a first intermediate frequency lower side band, with both said intermediate frequency upper side band and said intermediate frequency lower side band carrying said audio frequency signal;

ii. a second frequency reducer, capable of reducing the frequency of said first intermediate frequency upper side band and said first intermediate frequency lower side band to produce a second intermediate frequency upper side band and a second intermediate frequency lower side band, with both said second intermediate frequency upper sideband and said second intermediate frequency lower side band carrying said audio frequency signal;

ii. a second intermediate frequency upper side band detecting circuit tuned to detect the presence of said audio frequency signal on said second intermediate frequency upper side band and emit a first positive signal in response thereto;

iii. a second intermediate frequency lower side band detecting circuit tuned to detect the presence of said audio frequency signal on said second intermediate frequency lower side band and emit a second positive signal in response thereto; and iv. a logic unit configured to create an alarm when both said first positive signal and said second positive signal are present.

4. A system for detecting the presence of a passive electromagnetic wave receptor-reradiator as recited in claim 1, wherein said first and second transmitters are housed within a unified antenna housing.

5. A system for detecting the presence of a passive electromagnetic wave receptor-reradiator as recited in claim 2, wherein said first and second transmitters are housed within a unified antenna housing.

6. A system for detecting the presence of a passive electromagnetic wave receptor-reradiator as recited in claim 3, wherein said first and second transmitters are housed within a unified antenna housing.

7. A system for detecting the presence of a passive electromagnetic wave receptor-reradiator as recited in claim 1, further comprising an additional first transmitter and an additional second transmitter, placed proximate said first transmitter and said second transmitter proximate said doorway, in order to more completely cover said doorway with said low frequency signal modulated by an audio frequency signal and said high frequency signal.

8. A system for detecting the presence of a passive electromagnetic wave receptor-reradiator as recited in claim 2, further comprising an additional first transmitter and an additional second transmitter, placed proximate said first transmitter and said second transmitter proximate said doorway, in order to more completely cover said doorway with said low frequency signal modulated by an audio frequency signal and said high frequency signal.

9. A system for detecting the presence of a passive electromagnetic wave receptor-reradiator as recited in claim 3, further comprising an additional first transmitter and an additional second transmitter, placed proximate said first transmitter and said second transmitter proximate said doorway, in order to more completely cover said doorway with said low frequency signal modulated by an audio frequency signal and said high frequency signal.

10. A system for detecting the presence of a passive electromagnetic wave receptor-reradiator as recited in claim 1, wherein:

a. said low frequency signal is around 100 KHz;

b. said high frequency signal is around 915 MHz;

c. said intermediate frequency upper side band is around 10.8 MHz; and d. said intermediate frequency lower side band is around 10.6 MHz.

11. A system for detecting the presence of a passive electromagnetic wave receptor-reradiator as recited in claim 2, wherein:

a. said low frequency signal is around 100 KHz;

b. said high frequency signal is around 915 MHz;

c. said audio frequency signal is around 1 KHz;

d. said intermediate frequency upper side band is around 10.8 MHz; and e. said intermediate frequency lower side band is around 10.6 MHz.

12. A system for detecting the presence of a passive electromagnetic wave receptor-reradiator as recited in claim 3, wherein:

a. said low frequency signal is around 100 KHz;

b. said high frequency signal is around 915 MHz;

c. said audio frequency signal is around 1 KHz;

d. said first intermediate frequency upper side band is around 10.8 MHz; and e. said intermediate frequency lower side band is around 10.6 MHz.

13. A system for detecting the presence of a passive electromagnetic wave receptor-reradiator as recited in claim 1, wherein said logic unit configured to create an alarm when both said first positive signal and said second positive signal are present does not create an alarm until said first and second positive signals have been present for a fixed interval of time.

14. A system for detecting the presence of a passive electromagnetic wave receptor-reradiator as recited in claim 2, wherein said logic unit configured to create an alarm when both said first positive signal and said second positive signal are present does not create an alarm until said first and second positive signals have been present for a fixed interval of time.

15. A system for detecting the presence of a passive electromagnetic wave receptor-reradiator as recited in claim 3, wherein said logic unit configured to create an alarm when both said first positive signal and said second positive signal are present does not create an alarm until said first and second positive signals have been present for a fixed interval of time.

* * * * *